US006112350A

United States Patent [19]

Larson

[11] Patent Number: 6,112,350

[45] Date of Patent: Sep. 5, 2000

[54] AIR MATTRESS WITH STACKED HIGH AND LOW PRESSURE CHAMBERS

[76] Inventor: Lynn D. Larson, 5410 NW. 44th St., Lincoln, Nebr. 68524

[21] Appl. No.: 09/074,508

[22] Filed: May 7, 1998

[51] Int. Cl.[7] ..... A47C 27/10

[52] U.S. Cl. ..... 5/710

[58] Field of Search ..... 5/710, 713, 711, 5/706, 727, 615, 715

[56] References Cited

U.S. PATENT DOCUMENTS

| | | | |
|---|---|---|---|
| 4,594,743 | 6/1986 | Owen et al. | 5/711 |
| 4,617,690 | 10/1986 | Grebe | 5/710 |
| 4,803,744 | 2/1989 | Peck et al. | 5/706 |
| 4,873,731 | 10/1989 | Williamson | 5/715 |
| 5,105,488 | 4/1992 | Hutchinson et al. | 5/727 |
| 5,185,896 | 2/1993 | Bonda | 5/710 |

FOREIGN PATENT DOCUMENTS

| | | | |
|---|---|---|---|
| 122806 | 2/1919 | United Kingdom | 5/710 |
| 1261475 | 1/1972 | United Kingdom | 5/708 |

*Primary Examiner*—Alexander Grosz
*Attorney, Agent, or Firm*—Zarley, McKee, Thomte, Voorhees & Sease; Dennis L. Thomte

[57] ABSTRACT

An air mattress and method adapted to provide firm posture support and comfort, and to be supported on a flat surface. The mattress comprises a low pressure bag having a size and shape adapted to support a person during rest. A high pressure bag is adapted for inflation to a pressure higher than that of the low pressure bag and is of a size and shape to provide posture support as desired. An enclosure shell is adapted to enclose the high and low pressure bags with the second high pressure bag being disposed below the low pressure bag and at approximately the longitudinal center of the low pressure bag.

5 Claims, 3 Drawing Sheets

AIR MATTRESS WITH STACKED HIGH AND LOW PRESSURE CHAMBERS

TECHNICAL FIELD

The apparatus of the present invention relates generally to air mattresses. More specifically, it relates to an air mattress apparatus utilizing two separately inflatable enclosure bags comprising air of differing pressures.

To have everyday utility, an air mattress must be both comfortable and also sufficiently firm to provide support while sitting resting, or sleeping thereon. The present invention utilizes the aforementioned, separately inflatable bags to accomplish this. The larger, low pressure bag provides the surface on which the individual rests. The smaller, high pressure bag is used for support. Both bags may be enclosed in a single shell for convenience.

BACKGROUND OF THE INVENTION

Air mattresses have been known for some time. However, generally, these mattress are of a quality insufficient to permit long term, everyday use as bedding. Rather, they are generally intended for recreation, such as flotation in the water, or as temporary bedding such as on camp outs, or visits away from home. These conventional mattresses are generally constructed using thin plastic sheets.

One of the many problems with these conventional mattresses is the lack of an ability to provide any substantial support, especially when sitting or rising from the mattress. This results primarily from the use of a single inflatable enclosure designed for low pressure inflation.

SUMMARY OF THE INVENTION

Consequently, it is a primary objective of the present invention to provide an air mattress adapted to satisfy the goals of both support and comfort.

Another objective is to provide an air mattress having two separate enclosures, one having gas at a higher pressure to accomplish the support function and the other at a lower pressure and adapted to address the comfort function and provide the surface upon which the person rests.

An additional objective is to provide an air mattress having a bag inflated to a pressure such that its collapse is resisted, when weight is placed thereon, such as sitting.

An additional objective is to provide an air mattress having a plurality of higher pressure enclosures positioned to correspond to a plurality of positions requiring greater support.

An additional objective is to provide an air mattress wherein the higher and lower pressure bags are housed in a single shell.

An additional objective is to provide an air mattress adapted to fit into a frame for support above the ground.

A final objective is to provide an air mattress constructed of durable, yet light weight and inexpensive material.

The present invention discloses an air mattress adapted to provide firm posture support and comfort, and to be supported on a flat surface. The mattress comprises a low pressure bag having a size and shape adapted to support a person during rest. A high pressure bag is adapted for inflation to a pressure higher than that of the low pressure bag and is of a length less than the length of the low pressure bag as is adapted to provide posture support. An enclosure bag is adapted to substantially enclose the high and low pressure bags with the high pressure bag being disposed below the low pressure bag at approximately the longitudinal center of the low pressure bag.

In the preferred embodiment, it is anticipated that the high pressure bag would be inflated to a pressure between approximately 0.5 and 4 pounds per square inch above atmospheric pressure and the low pressure bag would be inflated to a pressure between approximately 0.25 and 0.5 pounds per square inch above atmospheric pressure. The low pressure bag may have a plurality of baffles positioned within the first bag. The high pressure bag would preferably be formed by folding at single sheet of material, in half, and sealing the periphery thereof. This high pressure bag may also be divided into two separately inflatable sections using an air-tight baffle, at approximately the center width thereof such that the firmness of each section may be separately adjustable.

The invention also teaches a method of providing enhanced support during sleeping or resting on an air mattress comprising the steps of providing an air mattress having, high and low pressure bag, the high pressure bag being of a size and shape for providing posture support to a particular point on the body and the low pressures bag being adapted for support of the total body during rest. The high pressure bag is inflated to a pressure of between approximately 0.5 and 4 pounds per square inch above atmospheric pressure. The high pressure bag is placed on the frame at a position corresponding to the place on the body where additional support is desired. The low pressure bag is inflated to a pressure between approximately 0.25 and 0.5 pounds per square inch above atmospheric pressure. The low pressure bag is placed on the frame with the second high pressure bag being disposed therebetween.

DESCRIPTION OF THE PREFERRED EMBODIMENT

Figure 1:
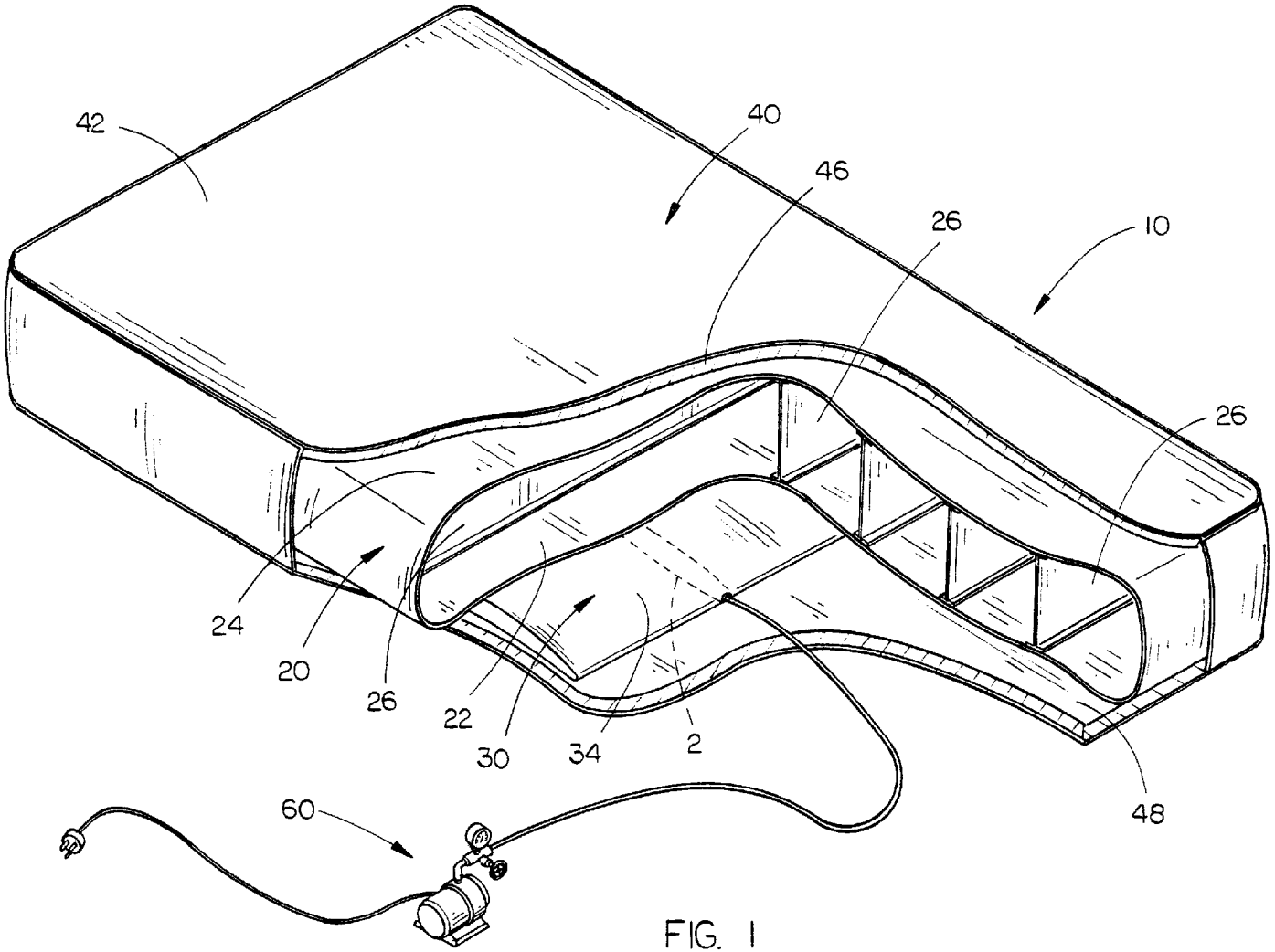
FIG. 1 is a perspective view illustrating the overall concept of the invention including the positioning of the high and low pressure bags would be utilized within the mattress.

The air mattress of the present invention discloses an apparatus which accommodates two somewhat countervailing objectives. Namely, providing a comfortable surface on which a person may rest, while at the same time having sufficient firmness or rigidity so as to provide sufficient support in those areas requiring such support. The present invention addresses these divergent goals by providing a mattress enclosure which comprises of a plurality of bags inflated to different pressures.

It will be understood by those in the art that a frequent problem encountered when sitting on the mattress is the annoying tendency to "bottom out", i.e. that the person's rear end will hit the floor. The present invention addresses this problem by providing a mattress enclosure shell or bag 40 containing a pressurized gas bag 30 of increased pressure positioned at the "bottoming out" point. While the most usual placement of this so called "high pressure bag" 30, is in the longitudinal center of the of the low pressure bag 20, the invention also teaches placement of additional bags at other positions requiring additional support.

Of course an air mattress is of no use if it is not comfortable, therefore in addition to providing support, consideration must also be given to comfort. The present invention 10 addresses this issue by providing another bag 20 comprising lower pressure gas. This so called "low pressure bag" 20 would comprises the sleeping surface. Consequently, the low pressure bag would be of conventional mattress size, e.g. king, queen, single etc. Conversely, high pressure bag 30, while extending the width of low pressure bag 20, has a length less than low pressure bag 20 being only long enough to provide the posture support, e.g. 12–24 inches. It is envisioned that high pressure bag 30 would be formed by simply folding in half a suitably sized sheet of material. This design requires seems on only three sides further minimizing costs and maximizing strength. The high pressure bag 30 may also be divided into two separately inflatable sections using an airtight baffle 2 at approximately the center width thereof that the firmness of each section may be separately adjustable.

It is anticipated that both high and low pressure bags 30 and 20 respectively, would be enclosed within a single bag or shell 40 with the high pressure bag 30 positioned below the low pressure bag 20 as seen in the figures. It is further anticipated that shell 40 enclosing the high and low pressure bags would be supported by a simple frame. One acceptable design would be a frame having a bottom and four walls ascending therefrom, the mattress being adapted to fit atop this bottom and within the four walls. Another acceptable support frame would be a conventional box spring. These various features are illustrated more clearly in the following figures. Still further, the mattress could be placed on the floor.

FIG. 1 is a perspective, cross-sectional view illustrating the mattress of the present invention. As seen in the figure, the invention comprises a shell 40 which encloses the remaining components of the invention. It is anticipated the shell 40 would be placed either on conventional box springs 50, in a simple frame, or even on the floor. Shell 40 may comprise a conventional mattress cover or may be a specially fabricated enclosure. Preferably some padding 46 and 48 may be provided on the upper and lower surfaces respectively for even greater comfort. Within cover or shell 40 is low pressure bag 20.

As illustrated in the figure, low pressure bag 20 comprises substantially the same dimensions as shell 40 and provides the basic sleeping surface. Thus, it is anticipated that the low pressure bag 20 would be manufactured in sizes corresponding to conventional bed sizes, e.g. king, queen, single etc.

It is also preferred that low pressure bag 20 would be manufactured with a series of baffles 26 running width-wise therethrough as shown in FIG. 1. These baffles 26 would serve to restrict the amount of "ballooning" which can sometimes occur with air mattresses. In the illustrated preferred design, the baffles are generally "I" shaped members. There is no need for an air-tight seal between the baffles and low pressure bag 20, in fact it is desirable to have free airflow. This would likely be accomplished by placing a series of holes (not shown) in each baffle 26 to ensure good airflow.

As mentioned above, low pressure bag 20 serves the function of providing the sleep support surface and comfort to the mattress. To this end, low pressure bag 20 is filled with air having a relatively "low" air pressure, as compared to high pressure bag 30. In the preferred embodiment, it is anticipated that low pressure bag 20 would be inflated to a pressure approximately 0.25–0.5 pounds per square inch above standard atmospheric pressure (i.e. 14.7 pounds per square inch at sea level). The method of filing low pressure bag 20 could be by any number of means. One such means is a conventional hand pump. Another such means could be a conventional electric pump. A control of some sort could be provided for selecting the desired degree of firmness. In one embodiment, a selector knob having "soft" and "hard" designations could be used. It is also anticipated that more precise pressure regulation could be accomplished using a transducer similar to the way a thermistor is used in temperature regulation. Use of the pressure transducer would allow a full range of pressure selections, corresponding to a wide range of firmnesses, to be made using a conventional control mechanism.

As mentioned above, the second function served by the mattress of the present invention is to provide additional support over that found in conventional air mattresses. This function is provided by high pressure bag 30.

As seen in the figure, high pressure bag 30 is positioned under low pressure bag 20. In the preferred embodiment, high pressure bag 30 extends the width of low pressure bag 20 but is more limited in length. Generally, the length of high pressure bag 30 would be just that required to provide the posture support desired, perhaps 12–24 inches. It is obvious that high pressure bag 30 must be constructed of heavier material since it is adapted to receive a higher pressure gas. Equally obvious, construction costs are greater with a heavier material. Thus, by maintaining high pressure bag 30 at just the size necessary to accomplish the task, costs are minimized.

As seen in FIG. 1, the high pressure bag 30 can be divided into two separately inflatable sections approximataly the center width thereof, symbolically shown by dotted line 2 such that the firmness of each section may be separately adjusted. In the preferred embodiment, it is anticipated that high pressure bag 30 will be inflated to a pressure between approximately 0.5–4 pounds per square inch above atmospheric pressure. This is believed sufficient to prevent the annoying "bottoming out" described above, which is common with conventional air mattresses. High pressure bag 30 would be filled with gas in precisely the manner described above in connection with low pressure bag 20 using a conventional pump.

It will be noted from the figure that high pressure bag 30 is positioned beneath low pressure bag 20 and at approximately the longitudinal center thereof. This positioning is also seen in the views discussed below. This positioning furthers the objectives of the invention. For example, when horizontally positioned on the mattress such as when sleeping or resting, the effect of high pressure bag 30 is not a significant factor. Low pressure bag 20 covers high pressure bag 30 and contact with high pressure bag 30 is avoided. Even so, there is still some additional cushioning effect over conventional mattresses since the indentations in low pressure bag 20, associated with compression by various part of the body, decreases the volume in low pressure bag 20 and consequently increases pressure. This "stiffens" the bag thereby resisting further depressing of low pressure bag 20 by various portions of the body. However, high pressure bag 30 provides maximum benefit when the individual is initially getting on or off the bag.

When an individual first gets on or off the bag, the person is most likely to "bottom out", since maximum weight concentration occurs at the point where the person is sitting. This results in a depressing of the low pressure bag at the weight concentration point. If the weight is sufficient, low pressure bag 20 may be depressed to the point where the top and bottom surfaces are pinched together. However, instead of contacting the floor, as would be the case with a conventional air mattress, contact will be made with high pressure bag 30. Since high pressure bag 30 inflated to an even greater pressure than that of low pressure bag 20, it will be obvious that, high pressure bag 30 will resist further downward depression. Therefore, the chance of bottoming out is minimized.

It will be observed from the figure that high pressure bag 30 is connected for inflation to a source of air by means of pump 60. Many different types of pumps are suitable, one example of which being a diaphragm pump. As mentioned above, there is a range of pressures which high pressure bag 30 could be inflated so as to provide the effect desired. As mentioned, there are many ways in which the correct pressure in the bag may be achieved and maintained. For example, as discussed above, conventional pressure gauges or even transducers may be used to verify the desired pressure. As discussed, this would allow precise measurement and maintenance of the desired pressure.

Figure 2:
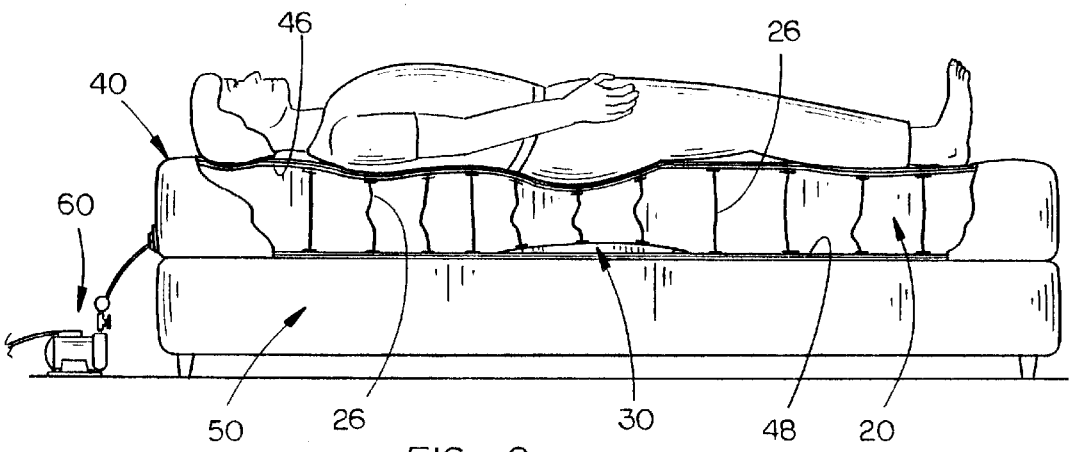
FIGS. 2 and 3 are side sectional views illustrating the high pressure bag in two inflation configurations and how it may be used to adjust posture.
Figure 3:
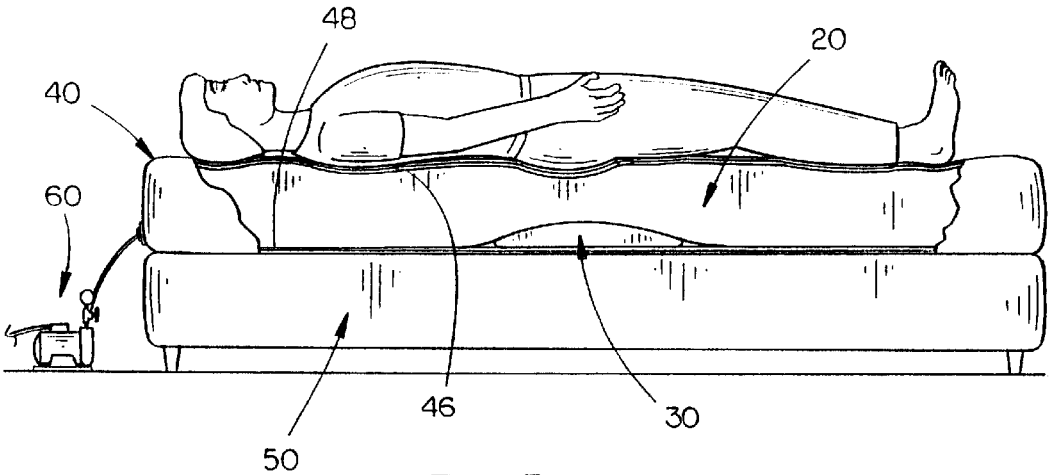

FIGS. 2 and 3 are cross-sectional side views showing the mattress in operation. It will be noted from the figures that high pressure bag 30 is in two different states of inflation. As mentioned, this is useful in allowing the feel of the mattress to be adjusted to suit individual tastes. Also illustrated in the figure is the benefit discussed above wherein the greater inflation of high pressure bag 30 results in a greater resistance to depression of low pressure bag 20 to a given weight. As mentioned above, by increasing the pressure in high pressure bag 30, a greater portion of low pressure bag 20 volume is consumed, since the amount of air within low pressure bag 20 is constant, this reduction in volume results in a corresponding increase in pressure. This correspondingly greater pressure results in a greater resistance to the depression of low pressure bag 20. FIGS. 2 and 3 also illustrate the compression of baffles 26 that occurs when an individual is resting on the mattress. If is contemplated that certain situations may suggest the use of more than one high pressure bag 30, this embodiment is illustrated in FIG. 4.

Figure 4:
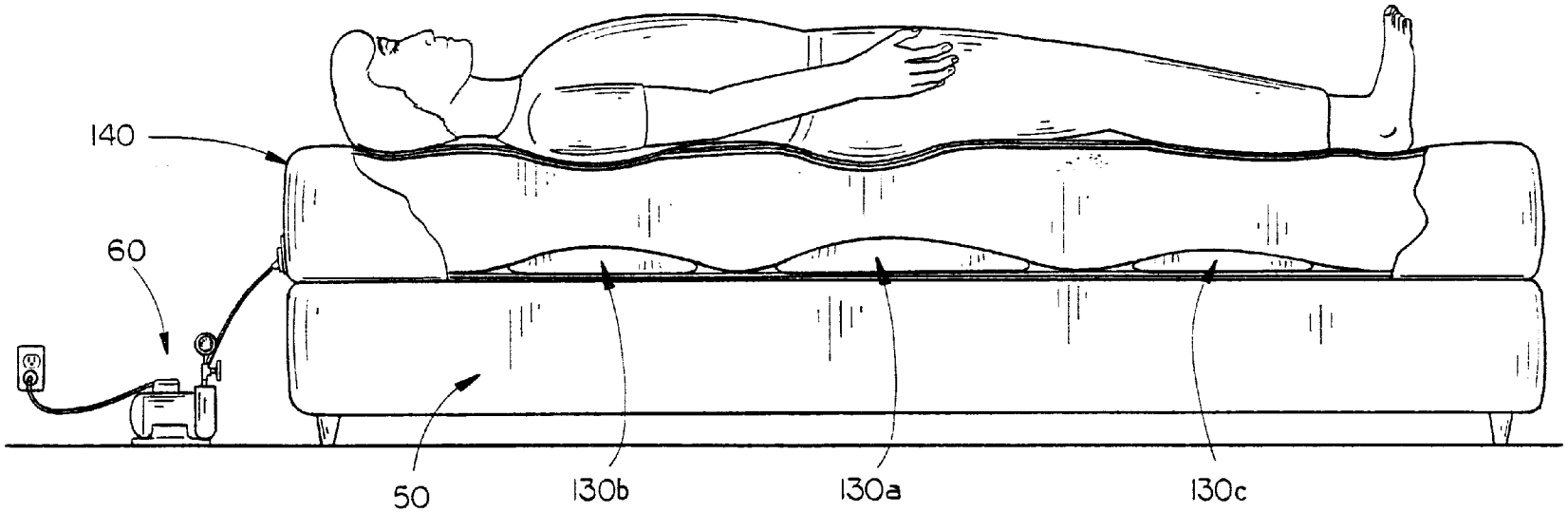
FIG. 4 is a side sectional view illustrating how a plurality of high pressure bags might be used.

FIG. 4 illustrates an alternative embodiment of the present invention wherein a plurality of high pressure bags 130*a–c* are utilized. It is contemplated that there are situations wherein support from a high pressure bag is desired at more than one position. In those cases, the present invention teaches that a plurality of bags 130*a–c* could be used and positioned at the points at which the support is desired. Such points might be not only at the center of mattress 140 but also at the shoulder region 130*b* and at calf position 130*c*. It further anticipates that these separate bags would be inflated at different pressures corresponding to the different weights being supported. Such a configuration is illustrated in the figure.

It is apparent that numerous other modifications and variations of the present invention are possible in view of the above teachings. For example, construction material and sizes of the bags may be altered as needed. Additionally, the means for inflating, and monitoring the inflation of the bags may be anything from a simple hand pump and gauge to a complicated transducer system.

Therefore, it is to be understood that the above description is in no way intended to limit the scope of protection of the claims and it is representative of only one of several possible embodiments of the present invention.

There has thus been shown and described an invention which accomplishes at least all the stated objectives.

I claim:

1. An air mattress adapted to provide firm posture support and comfort, and to be supported on a frame, the mattress comprising:

a first, low pressure bag having top and bottom walls and a side wall connecting the periphery thereof, said top, bottom and side walls defining an enclosed chamber for receiving and maintaining a quantity of pressurized gas therein;

a second, high pressure bag adapted for receiving and maintaining a quantity of pressurized gas therein at a pressure greater than the pressure within said low pressure bag, the high pressure bag having a length which is less than the length of said low pressure bag and being adapted to provide posture support said second, high pressure bag being divided into two separately inflatable sections at approximately the center width thereof, such that the firmness of each section may be separately adjustable; and an enclosure bag substantially enclosing said first and second bags with said second high pressure bag being disposed below said first low pressure bag at a position adjacent to the longitudinal center of the first low pressure bag.

2. The air mattress of claim 1 wherein the pressure of the gas in said second bag is between approximately 0.5 and 4 pounds per square inch above atmospheric pressure.

3. The air mattress of claim 1 wherein the pressure of the gas in said first bag is between approximately 0.25 and 0.5 pounds per square inch above atmospheric pressure.

4. The air mattress of claim 1 wherein said first bag further comprises a plurality of baffles positioned within said first bag.

5. The air mattress of claim 1 wherein said second bag is formed by folding a single sheet in half and sealing the periphery thereof.

* * * * *